United States Patent [19]

Ackerman et al.

[11] Patent Number: 5,070,823

[45] Date of Patent: Dec. 10, 1991

[54] PORT RODDER WITH ANTI-DRIFT FEATURE

[75] Inventors: Dean C. Ackerman, Lancaster; Francis L. Brown, Baltimore; James H. Hipple; Don W. Smith, both of Lancaster, all of Ohio

[73] Assignee: The Babcock & Wilcox Co., New Orleans, La.

[21] Appl. No.: 645,266

[22] Filed: Jan. 24, 1991

[51] Int. Cl.[5] ..... F22B 37/18; F22B 37/48

[52] U.S. Cl. ..... 122/379; 110/182.5; 122/6.5; 122/6.6; 266/269

[58] Field of Search ..... 122/379, 6.6, 6.5; 110/182.5; 266/269

[56] References Cited

U.S. PATENT DOCUMENTS

| | | | |
|---|---|---|---|
| 3,943,861 | 3/1976 | Astrom et al. | 110/182.5 |
| 4,099,471 | 7/1978 | Sander et al. | 110/182.5 |
| 4,653,409 | 3/1987 | Eriksson | 110/182.5 |
| 4,822,428 | 4/1989 | Goodspeed | 134/6 |
| 4,838,182 | 6/1989 | Goodspeed | 110/182.5 |

*Primary Examiner*—Edward G. Favors

*Attorney, Agent, or Firm*—Harness, Dickey & Pierce

[57] ABSTRACT

An anti-drift mechanism for a downwardly oriented port rodder for cleaning a port opening of a recovery boiler. The anti-drift mechanism prevents a cutter of the rodder from accidently drifting from a retracted holding position into the port upon the loss of holding power to the actuator. Two embodiments are disclosed. The first is a frictional engagement with the port rodder while the second involves the use of a valve in conjuction with the actuator to trap fluid pressure and maintain the rodder in the holding position.

16 Claims, 3 Drawing Sheets

PORT RODDER WITH ANTI-DRIFT FEATURE

BACKGROUND AND SUMMARY OF THE INVENTION

The present invention relates to a rodder for cleaning an air port in the wall of a recovery boiler. More particularly, the present invention is an alignment and safety system which allows for the adjustment of the rodder tip or cutter relative to the air port and prevents accidental drifting of the cutter into the air port upon a loss of power to the extension/retraction actuator of the rodder.

Port rodders are provided on recovery boilers to clean the primary air ports or openings, keeping them free from combustion by-products and other deposits commonly referred to as char. By frequently cleaning the port openings, air flow is uniform from all ports into the boiler thus facilitating a high rate of heat transfer and optimum operation.

A rodder generally consists of a tip or cutter mounted on the end of a ram which is in turn connected to an actuator which causes the ram to be extended or retracted. One such actuator would be a pneumatic cylinder. Extension and retraction of the cylinder causes the cutter to move in and out of the port. When extended into the port, the cutter contacts and dislodges the char by cutting and/or pushing it through the port and into the boiler.

Typically, a windbox is mounted on the exterior of the boiler so as to enclose at least one port. Air is supplied to the windbox and will pass through the enclosed port into the interior of the boiler. As the uniformity of the air flow is increased, so is the thermal and chemical reduction efficiency of the boiler. Unfortunately char tends to deposit on the interior surfaces of the boiler and build-up around the air ports. If left unchecked, the char will restrict the opening of the port and thereby inhibit uniform air flow.

Since a windbox is typically used to provide air to the boiler, rodders are mounted so as to extend through the windbox and into the port opening. The actuator, itself is generally mounted exteriorly of the windbox.

One problem encountered when using a port rodder is ensuring proper alignment between the cutter and the port opening. The problem exists because of broad tolerances between the air port castings and the mounting location of the rodder. Additionally, the cutter may extend over four feet from the exteriormost wall of the windbox with the actuator being positioned a distance therebeyond. If severely misaligned, it is possible that the cutter will bind within the air port.

Adjustments to the alignment of the port rodder have generally been limited to moving the cutter's position in a generally x-y plane relative to the port opening. Rotational alignment of the cutter (about its insertion axis) was limited to the play and sloppiness exhibited in the fit where the ram entered the windbox.

Additionally, port rodders which are mounted in an inclined position are capable of accidentally drifting into the port. When the rodder is mounted at an angle relative to the boiler, a loss of actuator power might enable the ram and cutter to be gravitationally extended into the port resulting in damage to the cutter. When extended as described above, long periods of exposure to the internal temperatures of the boiler result in the cutter edges becoming burned and distorted, thereby making the cutter inoperative or, at a minimum, less efficient. Once damaged, the cutter must be replaced resulting in increased operating expenses.

Since the rodder may be mounted with a downward inclination, it is an object of this invention to provide a means for preventing damage to the cutter because of the cutter drifting into the port opening upon a loss of power to the actuator.

It is also an object of the present invention to provide a port rodder with an anti-drifting mechanism while maintaining a highly adjustable alignment mechanism, one which readily enables vertical, horizontal and rotational adjustment of the cutter relative to the port opening.

An additional object of the present invention is to provide an anti-drifting rodder where significant misalignment between the actuator and ram will not cause excessive binding, stress or fatigue in either part.

In achieving the above mentioned objects, the rodder of the present invention is mounted to a wallbox that is attached to a windbox covering port at least one opening of a recovery boiler. The ram and cutter are positioned inside of the windbox while the actuator and alignment mechanism are positioned outside of the windbox and wallbox. Furthermore, the rodder is mounted with a downward inclination such that the cutter is positioned below the actuator.

The rodder is attached to the alignment mechanism, which is in turn secured to a mounting plate assembly of the wallbox. The alignment mechanism is provided with two plates. The first or exterior plate secures the actuator and is mounted to studs or posts extending from the wallbox mounting plate assembly. The first plate is attached to the studs in a manner which will permit the cutter position to be adjusted in a generally horizontal and vertical fashion relative to the port. The distance which the studs extend from the wallbox mounting plate assembly permits the first plate to be moved toward or away from the mounting plate assembly. This movement adjusts the axial distance that the cutter can be inserted into the port. The horizontal and vertical adjustments are made by shifting or tilting the first plate on the studs. To achieve this, the first plate is provided with clearance holes or bores and spherical washers. Through the incorporation of the spherical washers, the first plate, and the rodder, can be positioned at an angle relative to the wallbox mounting plate assembly without imparting bending loads on the studs.

A second or interior plate is positioned adjacent to the first plate. The second plate is releasably secured to the first plate so as to permit rotational movement about the insertion axis. To actually rotate the cutter, the second plate is fixably secured to a support housing in which the ram is disposed. When the second plate is rotated, the support tube causes the ram, and subsequently the cutter, to also rotate. Thus, the ram is disposed in the support housing in a way which will prevent relative rotation therebetween.

A coupler is provided to connect the actuator to the ram. The coupler allows for substantial misalignment between the extending portion of the actuator and the ram without affecting the overall operation of the rodder. The coupler is positioned between the ram and the extension rod of the actuator, respectively on the ends thereof.

The rodder is further provided with the anti-drift mechanism. Between cleaning strokes, fluid source pressure is supplied to the actuator to hold the cutter in its retracted position. This is the normal holding condition. A decrease or loss of fluid source pressure during the holding condition can result in gravitationally induced movement of the cutter towards the port. Such movement is now prevented by the incorporation of the anti-drift feature, two embodiments of which are disclosed. In one embodiment, if fluid source pressure is lost or decreases during the holding stage of operation, the back pressure of the fluid on the retraction side of the actuator will cause a check valve positioned in the source line to become engaged. The closing of the check valve thereby traps any remaining fluid on the retraction side of the actuator preventing extension of the cutter toward the air port. Alternatively, a frictional member, having a number of inwardly extending resilient fingers is positioned between the actuator and the first adjustment plate. The fingers are sufficiently stiff to engage the rodder and stop drift, but are resilient enough to allow for the "powered" passage of the rodder and subsequent extension of the cutter.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE DRAWINGS

Figure 1:
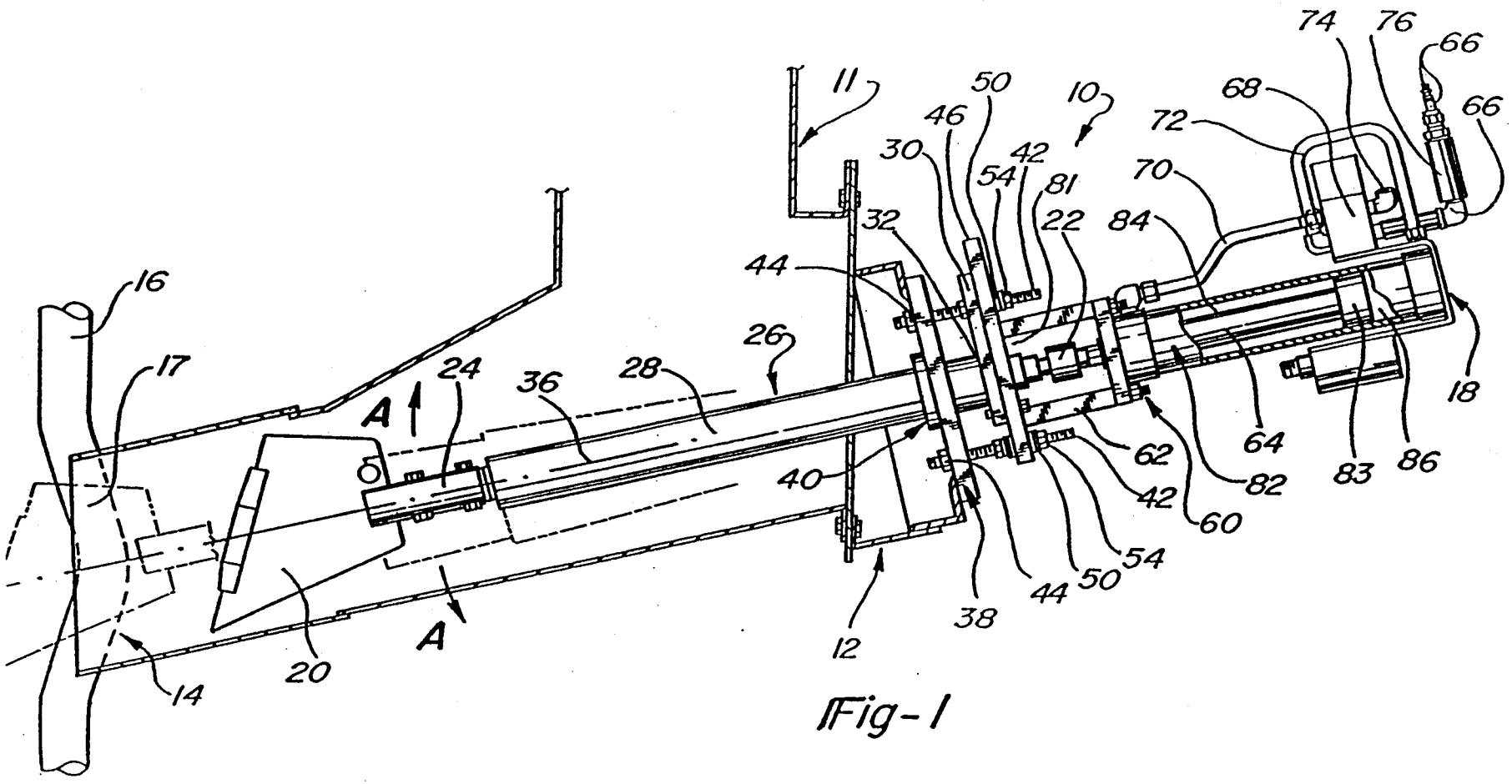
FIG. 1 is a side elevational view of an anti-drift port rodder embodying the principles of the present invention being shown in assembled relation with a wallbox, windbox and boiler tube.

Now with reference to the drawing, a port rodder is generally designated as 10 in FIG. 1 and is mounted to a wallbox 12 secured to a windbox 11 over a primary air port or opening 14 in a recovery boiler (not shown). The primary air port 14 is defined in a row of boiler tubes 16 by a pair of tubes 16 exhibiting outwardly diverging bends 17 to create the opening 14 therebetween. The port opening 14, along with the windbox 11 and wallbox 12, is often oriented so as to be inclined or upward facing relative to the remainder of the boiler.

The port rodder 10 generally includes an actuator 18 which is connected to a cutter 20 by its piston or extension rod 64, coupler 22 and ram 24. The actuator 18 may be one of the various types presently used in the industry and is more fully described below with its features that are unique to the present invention. The ram 24 and cutter 20 are supported for rotational adjustment in a weldment assembly 26 which includes a support tube 28, through which the ram 24 is extended, and a rotational adjustment plate 30 (further described below).

The port rodder 10 is secured to the wallbox 12, which is in turn secured to the windbox 11, at a wallbox mounting plate assembly 38. The assembly 38 has a central opening 40 through which the support tube 28 and the ram 24 extend. The opening 40 is provided in a manner which will not interfere with the adjustments being made to the rodder's 10 orientation. Additionally, the opening 40 may be surrounded by sealing rings, dust boots, etc. The wallbox mounting plate assembly 38 is further provided with a number of threaded adjustment studs or posts 42, four in the present embodiment, which extend outwardly therefrom. The studs 42 are secured to the wallbox mounting plate assembly 38 by conventional means, which could include threaded bores, lock nuts 44 and/or welds, as well as the studs 42 being threaded. In the drawings, the studs 42 are shown as being threaded and secured in threaded bores by lock nuts 44. The distance which the studs 42 extend beyond the mounting plate assembly 38 determines the distance that the cutter 20 may be axially adjusted along an insertion axis 36 relative to the port opening 14, and therefore, the distance it will extend into the opening 14.

An x-y adjustment plate 46 is provided with oversized clearance bores 48 that align with the adjustment studs 42. The diameter of each bore 48 is greater than that the studs 42 and allows the x-y adjustment plate's 46 position to be varied and to be offset or "tilted" relative to the wallbox mounting plate assembly 38. This manipulation of the x-y adjustment plate 46 allows the cutter 20 to be adjusted both horizontally and vertically relative to the port opening 14. For illustrative purposes, arrows A—A generally illustrate the vertical adjustability which the x-y adjustment plate 46 permits.

The weldment assembly 26 is secured directly to the x-y adjustment plate 46. Thus, if the x-y adjustment plate 46 is "tilted" on the studs 42 relative to the wallbox mounting plate assembly 38, the weldment assembly 26 will also be tilted causing the ram 24 and the cutter 20 to shift horizontally and/or vertically relative to the port opening 14. Subsequent shifting or tilting of the x-y adjustment plate 46 manipulates the cutter 20 until it is properly positioned for insertion into the port opening 14.

Once the cutter 20 has been positioned vertically and horizontally, the position of the x-y adjustment plate 46 is secured to the adjustment studs 42 by an adjusting nut assembly 50, 54. Securement of the "tilted" plate 46 is prevented from applying bending loads to the adjustment studs 42 by the provision of spherical washers 50 on both sides of the x-y adjustment plate 46. The tilting of the x-y adjustment plate 46 relative to the adjustment studs 42 causes the spherical surfaces 52 of the washers 50 to shift relative to one another and thereby allow locking nuts 54 and 54' to remain square relative to the adjustment studs 42. Other washers 58, such as lock washers, flat washers and tooth lock washers, may be incorporated as required to ensure the securement of the x-y adjustment plate 46. As an alternative, one of the lock nuts 54' could be secured to the adjustment studs 42 by welds. When this is done, the adjustment screws 42 themselves could be varied relative to the wallbox mounting plate assembly 38 to alter the position of the cutter 20.

As previously mentioned, the ram 24 and cutter 20 are supported for rotational adjustment by the weldment assembly 26. The rotational adjustment plate 30 of the weldment assembly 26 is welded 32 or otherwise fixably secured to the support tube 28 to prevent relative rotation therebetween. The ram 24 and cutter 20 are prevented from rotating relative to the weldment assembly 26 by a key and keyway 34 engagement between the ram 24 and the support tube 28. Thus, by rotating the adjustment plate 30 relative to the the x-y adjustment plate 46 (and therefore the wallbox 12), the cutter 20 is rotated about its insertion axis 36 relative to the port opening 14.

The rotational adjustment plate 30 is secured to the x-y adjustment plate 46 through three arcuate slots 78. The arcuate slots 78 may be formed in either the rotational adjustment plate 30 or the x-y adjustment plate 46. In either case, the centers of curvature exhibited by the slots 74 are coaxial with insertion axis 36.

In the present embodiment, the arcuate slots 78 are formed in the x-y adjustment plate 46 and corresponding bores 80 are formed in the rotational adjustment plate 30. Various fasteners 81 can be used to secure the plates 30 and 46 together. In the preferred embodiment, fasteners 81 are extended through the slots 78 and bores 80. When loosened, the fasteners 81 allow the rotational adjustment plate 30 to be rotated about the insertion axis 36 relative to the x-y adjustment plate 46. With the x-y adjustment plate 46 being fixed relative to the wallbox mounting plate assembly 38, the cutter 20 is caused to rotate relative to the port opening 14. This rotation is limited to approximately twelve degrees (12°) of adjustment in the present embodiment. However, a greater or lesser amount of adjustment may be provided.

Secured on the opposing side of the x-y adjustment plate 46 is the actuator 18. In the present embodiment, the actuator 18 is secured thereto by bolts 60 being extended through spacer rods 62. This provides an area between the plate 46 and the actuator 18 in which the piston rod 64 of the actuator 18 may be connected to the ram 24.

Connection of the ram 24 to the rod 64 is achieved through the employment of a coupler 22. The coupler 22 is fastened on opposing ends of the piston rod 64 and the ram 24 and forms a type of "universal joint" therebetween. This connection allows for rotation of the piston rod 64 and ram 24 and for some degree of angular misalignment therebetween. Thus, with some degree of misalignment being allowable, the need to insure substantial alignment between the actuator rod 64 and the ram 24 is eliminated. Without the coupler 22, if the cutter 20 was inserted into the opening 14 when the rod 64 was not substantially aligned with the ram 24, one would risk binding the ram 24 in the support tube 28 and causing both rod stress and bearing fatigue. Other types of couplers could also be used so long as they exhibit the necessary characteristics of permitting rotation and relative misalignment.

As previously stated, actuators 18 of numerous varieties can be used with the present invention, including pneumatic and hydraulic cylinders. The preferred embodiment employs a pneumatic cylinder 82 because of its dependability and relatively low cost. To operate the cylinder 82, a positive pressure air supply source (not shown) provides air via an inlet conduit 66 to a solenoid operated control valve 68 of a type commonly know within the industry. Depending upon the biasing of the control valve 68, supply air is provided through a retraction conduit 70 to a retraction side 84 of the cylinder 82 (or to an extension side 86 of the cylinder 82 through an extension conduit 72). As the pilot control valve 68 permits source air to be provided to one side of the cylinder 82, the opposing side of the cylinder 82 is allowed to communicate with the atmosphere through a vent 74. In that the opposing sides of the cylinder 82 are separated by a piston head 83, as air pressure increases on one side of the cylinder 82, a piston 83 and the rod 64 will be caused to move within the cylinder 82, evacuating the air on the opposing side of the piston 83.

The port opening 14 of the boiler must be periodically cleaned to optimize efficiency and promote uniform air flow. In so doing, pressurized air is provided to the extension side 86 of the cylinder 82 causing the piston 83, rod 64, ram 24 and cutter 20 to move towards the opening 14. As cutter 20 enters the opening 14, char that has been deposited since the last cleaning cycle is engaged by the cutter 20 and dislodged from the opening 14.

Once the opening 14 has been cleaned, the control valve 68 is biased to provide source air to the retraction side 84 of the cylinder 82, thereby causing the cutter 20 to retract out of the opening 14. Between cleaning cycles, pressure is maintained on the retraction side 84 of the cylinder 82 and the cutter 20 is held out of the opening 14 in the retracted position.

As stated above, the port opening 14 and the windbox 11 may be inclined relative to the remainder of the boiler. When mounted in this inclined fashion, a loss of air pressure between the cleaning cycles can result in the cutter 20 drifting into the opening 14 under the force of gravity. If this drift is not stopped or prevented, the cutter 20 can become damaged and require repair. If allowed to remain within the opening 14 for an extended period of time, the cutter 20 can become burned or warped making the cutter 20 inoperative or less efficient. Maintenance might then involve the removal of the rodder 10 or the replacement of the cutter 20.

To prevent drift and its subsequent damage, the present invention incorporates an anti-drift mechanism when the rodder 10 is inclined at an angle greater than ten degrees (10°). Applicant has found that when inclined above 10°, the chances are increased that the extendable portions of the rodder 10 will overcome the inherent friction of the system and allow drift to begin.

As mentioned above, the cutter 20 is normally held in a retracted position out of the port opening 14. In this stage, the control valve 68 is biased to provide pressurized air through the retraction conduit 70 while the extension side 86 of the cylinder 82 is in communication with the vent 74. If air pressure is substantially lost from the source, the combined weight of the piston 83, rod 64, ram 24 and cutter 20 may overcome the friction inherent in the system and allow the cutter 20 to drift into the opening 14. This extension will force air to be evacuated from the retraction side 84 of the cylinder 82 back into the source. With the extension side 86 of the cylinder 82 being in communication with the ambient surroundings via the vent 74, air is permitted enter the extension side 86 of the cylinder 82 without hindering the drift.

To avoid this drift, the present invention is provided with a check valve 76 in-line between the source of pressurized air and the control valve 68. The check valve 76 can be one of numerous known varieties, including ball check valves and spring loaded check valves.

Once source pressure is lost and the inherent friction of the system is overcome, the extendable portions of the cylinder 82 begin to drift toward the opening 14 causing air to be evacuated from the retraction side 84 of the cylinder 82. The control valve 68 remains biased to permit communication between the retraction conduit 70 and the air source. Evacuating air passes through control valve 68 and biases the check valve 76 closed. The air remaining on the retraction side 84 of the cylinder 82 thus becomes trapped by the closing of the check valve 76. Drift is thereby stopped with only a minor amount having been incurred. The amount of drift that is incurred is insufficient to extend the cutter 20 into the opening 14 because of the ease with which the check valve 76 is biased closed.

While it is preferred that the check valve 76 is positioned in-line between the source of air pressure and the remainder of the system, it is conceivable that the check valve 76 could be positioned elsewhere in the actuator 18 source system.

Figure 4:
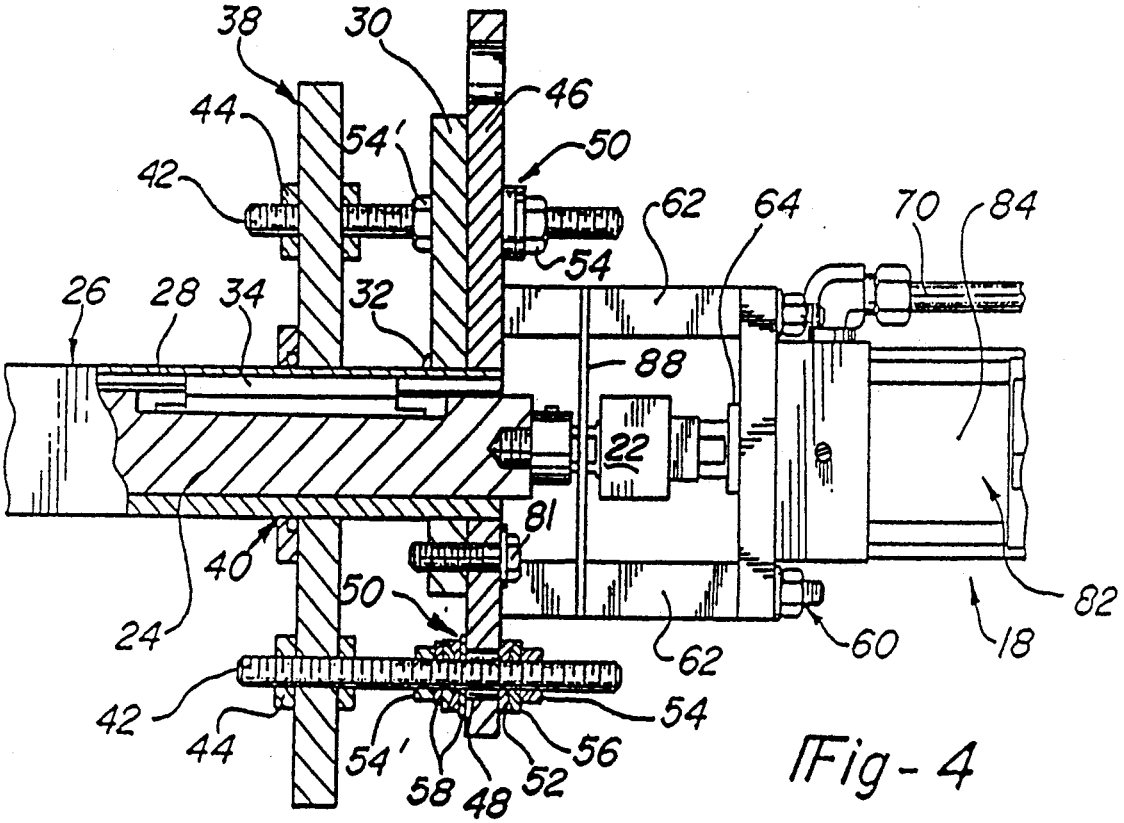
FIG. 4 is a sectional view substantially similar to FIG. 2 and showing the drift preventing spring member.
Figure 5:
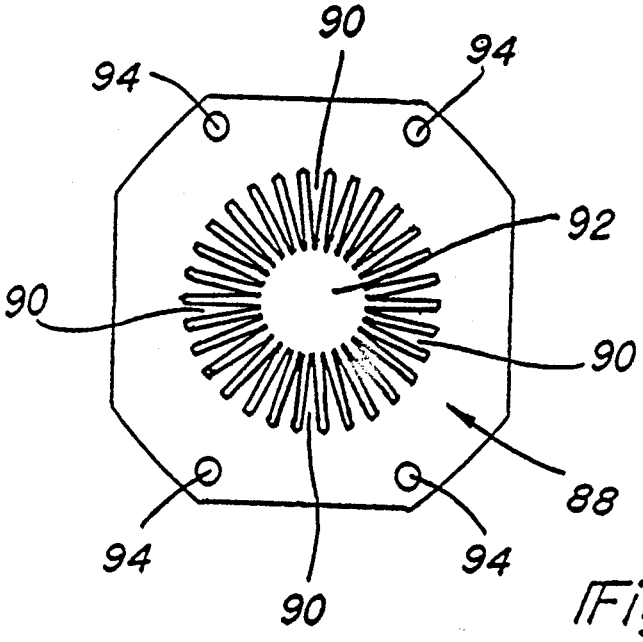
FIG. 5 is an front elevational view of the anti-drift spring member of FIG. 4.

An alternative anit-drift mechanism is illustrated in FIGS. 4 and 5. Where appropriate like elements have been designated with like references.

Figure 2:
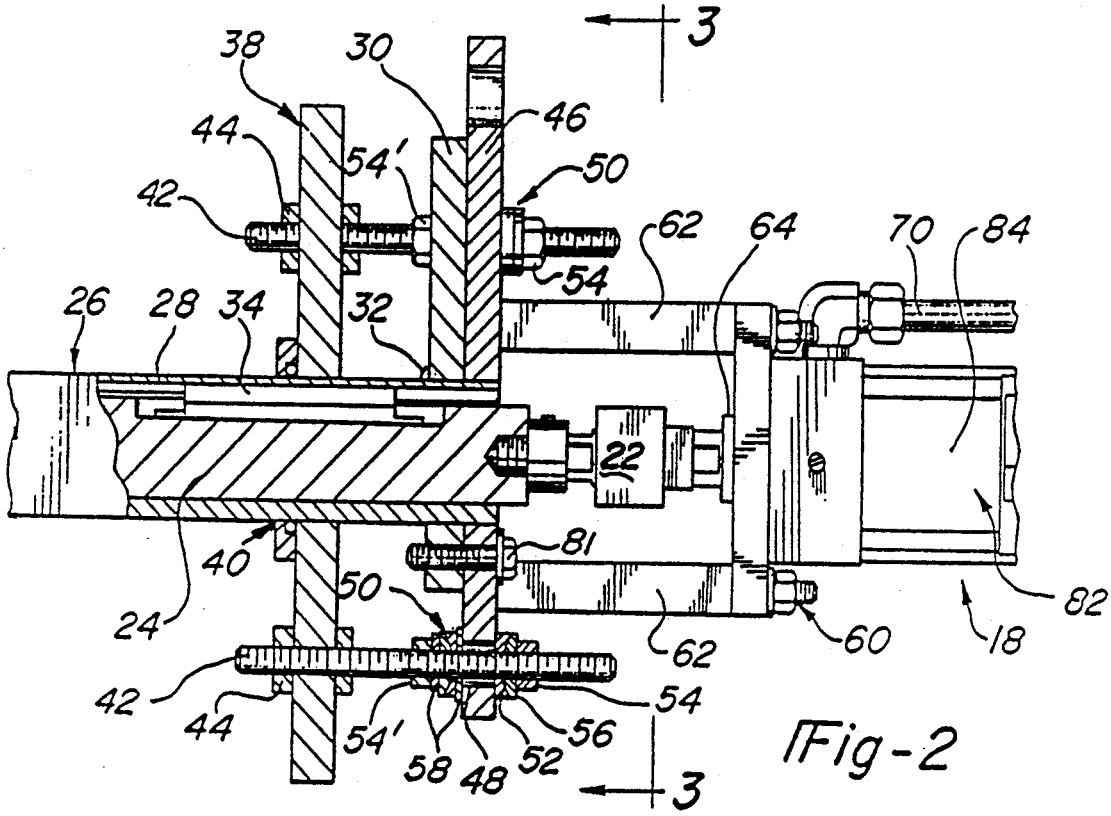
FIG. 2 is a sectional view of an alignment mechanism and coupler embodying the principles of the present invention.
Figure 3:
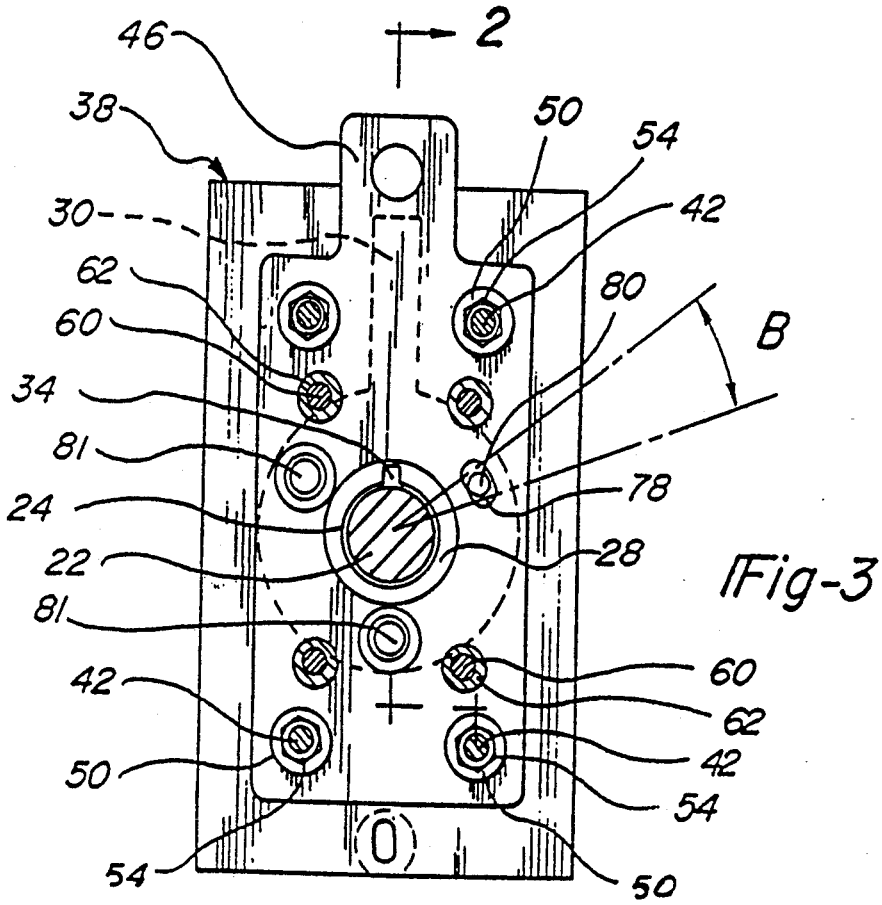
FIG. 3 is a sectional view taken substantially along line 3—3 in FIG. 2 of the alignment mechanism.

In this alternative embodiment, the port rodder 10 is provided with a "passive" anti-drift mechanism. The "passive" anti-drift mechanism includes a spring or friction member 88 having a plurality of resilient fingers 90 which extend radially inward of an aperture 92 centrally defined therein. The spring member 88 is positioned between the actuator 18 and the x-y adjustment plate 46, with its aperture 92 aligned with the ram 24. While the spring member 88 may be mounted in any convenient manner, it can easily be secured by the spacers 62 and bolts 60 if provided with a number of mounting bores 94. Here, the embodiment of FIG. 4 differs from FIG. 2 in that it includes the spring member 88 and the spacers 62 are of a split or two piece construction.

The fingers 90 are sufficiently resilient to allow the ram 24, coupler 22 and rod 64 to be driven by the actuator 18 through the aperture 92, both for extension and retraction of the cutter 20. However, the fingers 90 are sufficiently rigid so as to support the load of the cutter 20, ram 24, coupler 22, rod 64 and piston 83 when the source of air pressure has been lost. When drift begins, the fingers 90 readily engage the coupler 22 preventing the cutter 20 from drifting into the port opening 14. Alternatively, the fingers 90 could engage portions of the ram 24 or rod 64.

As seen from the above discussions, both anti-drift mechanisms are self-actuating in that they respond only to the unintentional drifting of the cutter 20 toward the port opening 14. This is advantageous in that neither mechanism requires the addition expense of providing a separate monitoring system to activate the anti-drift mechanism.

While the above description constitutes the preferred embodiment of the present invention, it will be appreciated that the invention is susceptible to modification, variation and change without departing from the proper scope and fair meaning of the accompanying claims.

We claim:

1. A drift prevention apparatus for a cleaning device being insertable into and retractable from a boiler for preventing the cleaning device from inadvertently becoming inserted into the boiler between actuation cycles due to the influences of forces such as gravity and vibration, said apparatus comprising:

actuator means for causing insertion of the device from a retracted position to an extended position in the boiler and for causing retraction of the device from the boiler, during an actuation cycle; and anti-drift means for restricting movement of the device from said retracted position toward said extended position between said actuation cycles thereof, said anti-drift means permitting said actuation by said actuator means causing insertion of the device into the boiler.

2. A drift prevention apparatus as set forth in claim 1 wherein said anti-drift means includes a member in mechanical contacting engagement with the cleaning device, said mechanical contacting engagement thereby restricting movement of the cleaning device between said actuation cycles thereof.

3. A drift prevention apparatus as set forth in claim 2 wherein said member is in frictional contacting engagement with the cleaning device.

4. A drift prevention apparatus as set forth in claim 3 wherein said member includes at least one resilient finger extending therefrom, said finger having a terminal end in frictional engagement with the cleaning device thereby restricting movement of the device between said actuation cycles thereof.

5. A drift prevention apparatus as set forth in claim 4 wherein said member includes a plurality of resilient fingers extending therefrom, said fingers having terminal ends generally defining an aperture in said member through which the device extends, said terminal ends frictionally engaging the device with a friction force sufficient to restrict movement of the device between said actuation cycles thereof.

6. A drift prevention apparatus as set forth in claim 1 wherein said actuator means includes a fluid pressure operated cylinder and a pressure supply source providing pressure to said cylinder, said anti-drift means further including a valve being operable to maintain pressure for holding the device in said retracted position upon a failure of aid supply source to provide pressure to said cylinder to so hold the device between said actuation cycles thereof.

7. A port rodder for cleaning a port opening in a boiler, said port rodder comprising:

a cleaning device having a cutter coupled to one end;

actuator means for extending said cutter so as to insert said cutter into the port opening of the boiler thereby cleaning the port opening, said actuator means also for retracting said cutter so as to withdraw said cutter from the port opening to a retracted position; and anti-drift means for stopping inadvertent extending of said cutter prior to subsequent required cleaning of the port opening and intentional extension by said actuator means, said anti-drift means including a member in frictional engagement with said cleaning device, said frictional engagement being sufficient to stop inadvertent extension of said cutter not caused by said actuator means and insufficient to stop extension of said cutter caused by said actuator means.

8. A port rodder as set forth in claim 7 wherein said member includes a plurality of resilient fingers integrally formed therein and having ends in frictional engagement with said cleaning device.

9. A port rodder as set forth in claim 8 wherein said fingers are radially oriented inwardly so as to define an aperture centrally located in said member, said cleaning device having a component being positioned through said aperture and engaged by said ends.

10. An actuator for a port rodder having a axially extendable ram and being coupled to a cutting member for insertion into an air port of a boiler for cleaning thereof, said actuator comprising:

a cylinder having a piston disposed therein and defining an extension side and a retraction side;

a pressure supply source and means for alternating communication between said source and said extension and retraction sides, said piston being coupled to said ram whereby the supplying of said pressure to said extension side causes the extension of said ram for cleaning said air port and the supplying of said pressure to said retraction side retracts said ram subsequent to cleaning of said air port, said pressure being supplied to said retraction side between cleaning cycles thereby retaining said ram in a retracted position; and means for maintaining said pressure on said retraction side between cleaning cycles during a loss of pressure from said supply source thereby preventing the unintentional extension of said ram toward said air port.

11. A actuator for a port rodder as set forth in claim 10 wherein said pressure maintaining means includes a valve preventing the backflow of pressure from said retraction side to said supply source.

12. An actuator as set forth in claim 11 wherein said valve is a check valve.

13. An actuator as set forth in claim wherein said valve is a ball check valve.

14. A drift prevention apparatus for a cleaning device being insertable into and retractable from a boiler for preventing the cleaning device from inadvertently becoming inserted into the boiler between actuation cycles due to the influences of forces such as gravity and vibration, said apparatus comprising:

actuator means for causing insertion of the device into the boiler and for causing retraction of the device from the boiler during the actuation cycle; and anti-drift means for preventing insertion of the device into the boiler between such actuation cycles thereof, said anti-drift means permitting said actuation by said actuator means, said anti-drift means having a member including at least one resilient finger extending therefrom, said finger having a terminal end in frictional engagement with the device thereby preventing insertion of the device between insertion cycles thereof.

15. A drift prevention apparatus as set forth in claim 14 wherein said member includes a plurality of resilient fingers extending therefrom, said fingers having terminal ends generally defining an aperture in said member through which the device extends, said terminals end frictionally engaging the device with a friction force sufficient to prevent insertion of the device between said actuation cycles thereof.

16. A drift prevention apparatus for a cleaning device being insertable into and retractable from a boiler for preventing the cleaning device from inadvertently becoming inserted into the boiler between actuation cycles due to the influences of forces such as gravity and vibration, said apparatus comprising:

actuator means for causing insertion of the device into the boiler and for causing retraction of the device from the boiler during an actuation cycle including a pressure operated cylinder and a pressure supply source providing pressure to said cylinder, and anti-drift means for preventing insertion of the device into the boiler between said actuation cycles thereof, said anti-drift means permitting said actuation by said actuation means, said anti-drift means including a valve being operable to maintain pressure for holding the device in said retracted position upon a failure of said supply source to provide pressure to said cylinder to so hold the device between said actuation cycles thereof.

* * * * *

UNITED STATES PATENT AND TRADEMARK OFFICE

CERTIFICATE OF CORRECTION

PATENT NO. : 5,070,823

DATED : December 10, 1991

INVENTOR(S) : Ackerman et al

It is certified that error appears in the above-identified patent and that said Letters Patent is hereby corrected as shown below:

ON THE TITLE PAGE:

Abstract, lines 8-9, "conjuction" should be --conjunction--.

Column 3, line 42, "an" should be --a--.

Column 3, line 45, "DRAWINGS" should be --PREFERRED EMBODIMENTS--.

Column 4, line 24, after "that" insert --of--.

Column 4, line 65, after "welded" insert --at--.

Column 5, line 3, (third occurrence), delete "the".

Column 5, line 59, "know" should be --known--.

Column 6, line 53, after "permitted" insert --to--.

Column 7, line 14, "anit-drift" should be --anti-drift--.

Column 7, line 46, "addition" should be --additional--.

Column 8, line 32, claim 6, "aid" should be --said--.

Column 8, line 63, claim 10, (second occurrence), "a" should be --an--.

Column 9, line 17, claim 11, "A" should be --An--.

UNITED STATES PATENT AND TRADEMARK OFFICE

CERTIFICATE OF CORRECTION

PATENT NO. : 5,070,823

DATED : December 10, 1991

INVENTOR(S) : Ackerman, et al

It is certified that error appears in the above-identified patent and that said Letters Patent is hereby corrected as shown below:

Column 9, line 23, claim 13, after "claim" insert --11--.

Column 10, line 31 claim 16, "actuation" should be --actuator--.

Signed and Sealed this

Tenth Day of August, 1993

*Attest:*

Michael K. Kirk

MICHAEL K. KIRK

*Attesting Officer*

*Acting Commissioner of Patents and Trademarks*